US010180651B2

(12) United States Patent
Tagami et al.

(10) Patent No.: US 10,180,651 B2
(45) Date of Patent: Jan. 15, 2019

(54) IMAGE FORMING APPARATUS WITH RESTRICTING MEMBER THAT RESTRICTS MOVEMENT OF CARTRIDGE

(71) Applicant: CANON KABUSHIKI KAISHA, Tokyo (JP)

(72) Inventors: Kenichi Tagami, Tokyo (JP); Tomio Noguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/491,457

(22) Filed: Apr. 19, 2017

(65) Prior Publication Data

US 2017/0308030 A1 Oct. 26, 2017

(30) Foreign Application Priority Data

Apr. 22, 2016 (JP) ..... 2016-086059

(51) Int. Cl.
*G03G 21/18* (2006.01)
*G03G 21/16* (2006.01)

(52) U.S. Cl.
CPC ..... *G03G 21/1647* (2013.01); *G03G 21/1676* (2013.01); *G03G 21/1842* (2013.01); *G03G 21/1853* (2013.01)

(58) Field of Classification Search
CPC ..... G03G 21/1647; G03G 21/181; G03G 21/1839; G03G 21/1842
USPC ..... 399/110, 111, 113, 119
See application file for complete search history.

(56) References Cited

U.S. PATENT DOCUMENTS 8,185,013 B2 * 5/2012 Kikuchi et al. .... G03G 21/1647 399/111

FOREIGN PATENT DOCUMENTS

JP H04350033 A 12/1992

* cited by examiner

*Primary Examiner* — William J Royer
(74) *Attorney, Agent, or Firm* — Canon U.S.A., Inc. IP Division

(57) ABSTRACT

An image forming apparatus includes a contact-separation mechanism that causes a photosensitive drum and a developer-bearing member to come into contact with each other or to separate from each other and a restricting member that restricts movement of a cartridge with the cartridge installed in a main body of the image forming apparatus. In the image forming apparatus, the contact-separation mechanism causes the photosensitive drum and the developer-bearing member to separate from each other while the restricting member restricts the movement of the cartridge with the cartridge installed in the main body. The restriction of the movement of the cartridge by the restricting member is released in conjunction with operation of bringing the photosensitive drum and the developer-bearing member into contact with each other by the contact-separation mechanism.

27 Claims, 11 Drawing Sheets

IMAGE FORMING APPARATUS WITH RESTRICTING MEMBER THAT RESTRICTS MOVEMENT OF CARTRIDGE

BACKGROUND OF THE INVENTION

Field of the Invention

The present invention relates to an image-forming apparatus, such as a copying machine, a printer, or a facsimile machine, which has a function to form an image on a recording medium such as a sheet material.

Description of the Related Art

FIG. 10 illustrates an image-forming apparatus that uses a typical electrophotographic process. In FIG. 10, sheet materials 1 are stacked in a sheet tray 2. When a host computer, not illustrated, that is connected to the main body A (apparatus main body) of the image-forming apparatus instructs to send a print-job signal, a feed roller 3 disposed in the apparatus main body A rotates, and each sheet material 1 stacked in the sheet tray 2 is fed. The sheet material 1 guided by a conveyance guide 4 is transferred to a transfer unit formed of a nip portion between a photosensitive drum 8 and a transfer roller 9 by using a pair of conveyance rollers 5, and a scanner unit 6 fixes the timing of the transfer with image information formed on the photosensitive drum 8 in a process cartridge B. In the meantime, a toner image is developed on the photosensitive drum 8 by using a development roller 17 in the process cartridge B. Transfer bias is applied to the transfer roller 9 to perform a transfer process, and the toner image formed on a surface of the photosensitive drum 8 is transferred to the sheet material 1. After the transfer process, the sheet material 1 is conveyed to a fixing device 10, and a fixing process is performed by using heat and pressure to fix the toner image to the sheet material 1. After the fixing process, the sheet material 1 is discharged to and loaded on a discharge tray 12 by using a pair of discharge rollers 11.

In recent years, the apparatus main body A is shipped from a factory to a user in a state where the process cartridge B is installed in the apparatus main body A and packed together. The size of packing of the image-forming apparatus is reduced to improve a distribution efficiency.

As illustrated in FIG. 11A, the process cartridge B installed in the apparatus main body A during packing and shipment is secured by using a cushioning material 16 disposed in the apparatus main body A so as not to move due to a vibration or an impact during transportation (Japanese Patent Laid-Open No. 4-350033). The cushioning material 16 is inserted into a space between the process cartridge B and a door 15 in the apparatus main body A to fix the process cartridge B.

However, in the case where the cushioning material16 is disposed in the apparatus main body A, it is necessary for the cushioning material 16 to be removed from the apparatus main body A when the image-forming apparatus is used for the first time in order to prevent malfunction caused by a force applied from the cushioning material 16 to the process cartridge B. More specifically, when the apparatus main body A starts to operate for printing with the cushioning material 16 disposed in the apparatus main body A, a frame body bends due to the force applied to the process cartridge B. This changes a contact pressure between the photosensitive drum 8 and a charge roller or a contact pressure between the photosensitive drum and the development roller 17 in the process cartridge B, and there is a possibility of failures such as a variation in the tint of an image and an uneven image in a direction in which a sheet is fed.

Accordingly, as illustrated in FIG. 11B, when a user uses the image-forming apparatus for the first time, the user opens the door 15 in the direction of an arrow Q, extracts the cushioning material 16 in the direction of an arrow R, and removes the cushioning material 16 from the inside of the apparatus main body A.

However, in the case where the cushioning material 16 is disposed in the apparatus main body A, the cushioning material 16 needs to be removed, reducing usability. There is still a possibility that the image-forming apparatus is powered on before the cushioning material 16 is removed, and a force is applied from the cushioning material 16 to the process cartridge B, so that malfunction occurs.

SUMMARY OF THE INVENTION

The present invention has been accomplished in view of the above problems and provides an image-forming apparatus in which it is not necessary for a user to remove the cushioning material when the apparatus main body is installed and malfunction of the image-forming apparatus that is cause by the cushioning material can be prevented from occurring. The present invention also provides an image-forming apparatus that can start to operate only in a manner in which the image-forming apparatus is taken out of a packing box, a power cord and a communication cable are connected thereto, and the apparatus main body is powered on immediately after installation.

An image-forming apparatus according to an embodiment of the present invention includes a cartridge that is attachable and detachable, includes a drum cartridge including a photosensitive drum, and includes a developing cartridge including a developer-bearing member that supplies a developer to the photosensitive drum, a contact-separation mechanism that causes the photosensitive drum and the developer-bearing member to come into contact with each other or to separate from each other, and a restricting member that restricts movement of the cartridge with the cartridge installed in a main body of the image forming apparatus. The contact-separation mechanism causes the photosensitive drum and the developer-bearing member to separate from each other while the restricting member restricts the movement of the cartridge with the cartridge installed in the main body. The restriction of the movement of the cartridge by the restricting member is released in conjunction with operation of bringing the photosensitive drum and the developer-bearing member into contact with each other by the contact-separation mechanism.

An image-forming apparatus according to another embodiment of the present invention forms an image on a sheet material and includes a cartridge that is attachable and detachable, a sheet-feeding roller that comes in contact with the sheet material and thereby enables the sheet material to be conveyed, a movement mechanism that causes the sheet material to come into contact with the sheet-feeding roller or to separate from the sheet-feeding roller, and a restricting member that restricts movement of the cartridge with the cartridge installed in a main body of the image forming apparatus. The movement mechanism causes the sheet-feeding roller and the sheet material to separate from each other while the restricting member restricts the movement of the cartridge with the cartridge installed in the main body. The restriction of the movement of the cartridge by the restricting member is released in conjunction with operation of bringing the sheet-feeding roller and the sheet material into contact with each other by the movement mechanism.

An image-forming apparatus according to another embodiment of the present invention forms an image on a sheet material and includes a cartridge that is attachable and detachable, a movable member that is movable with respect to a main body of the image-forming apparatus and enables the sheet material to be supplied, and a restricting member that restricts movement of the cartridge with the cartridge installed in the main body of the image forming apparatus. The movable member is secured to the main body of the image-forming apparatus while the restricting member restricts the movement of the cartridge with the cartridge installed in the main body. The restriction of the movement of the cartridge by the restricting member is released in conjunction with operation of moving the movable member with respect to the image forming apparatus.

Further features of the present invention will become apparent from the following description of exemplary embodiments with reference to the attached drawings.

DESCRIPTION OF THE EMBODIMENTS

Modes for carrying out the present invention will hereinafter be described in detail by way of example on the basis of embodiments with reference to the drawings. The size, material, and shape of components and relative positions of the components that are described in the embodiments are changed appropriately depending on the structure and various conditions of an apparatus to which the present invention is applied. The embodiments do not limit the range of claims of the present invention.

First Embodiment

An image-forming apparatus according to a first embodiment of the present invention will now be described in detail. The structure and image-forming processes of the image-forming apparatus and the outline of operations from the start of feeding a sheet material to discharging the sheet material are the same as in conventional image-forming apparatuses, and description thereof is omitted. Components having functions like to those in conventional image-forming apparatuses are designated by like symbols. In the following description, the front side of the image-forming apparatus on which a sheet tray opens or closes is referred to as a front face, and the rear side thereof is referred to as a rear face. The face of the image-forming apparatus on the upper side in the vertical direction when the image-forming apparatus is placed on a horizontal plane is referred to as an upper face.

Figure 1:
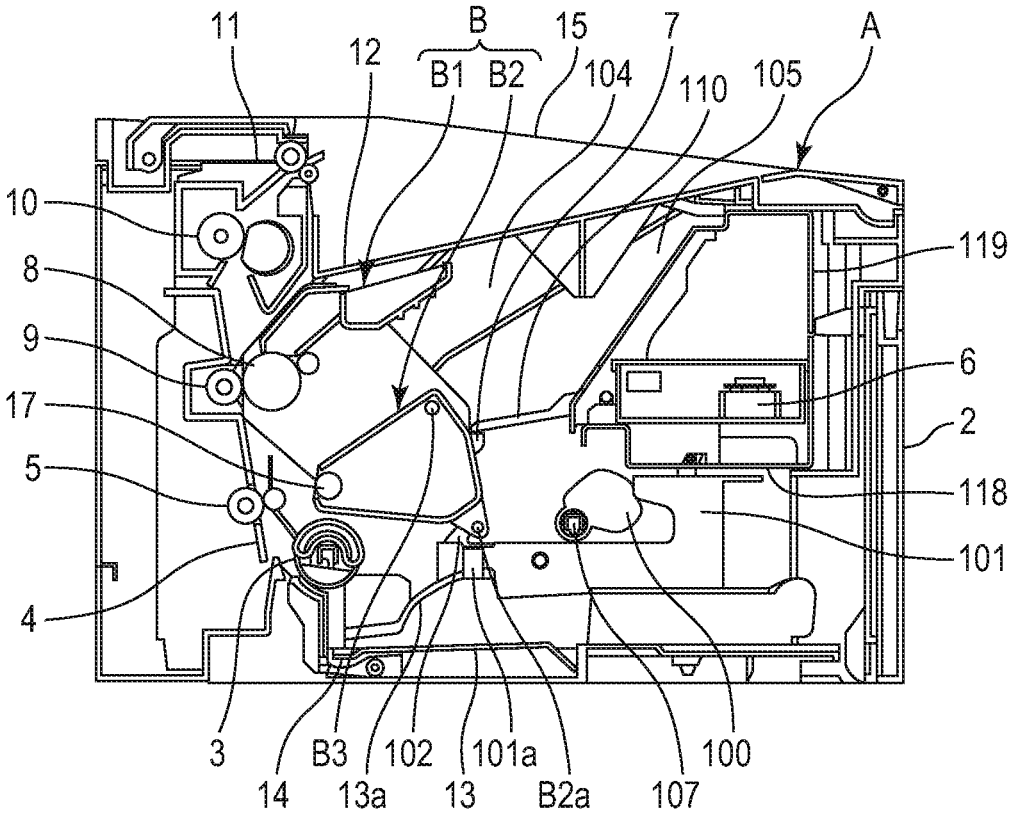
FIG. 1 is a sectional view of an image-forming apparatus according to a first embodiment of the present invention.
Figure 2:
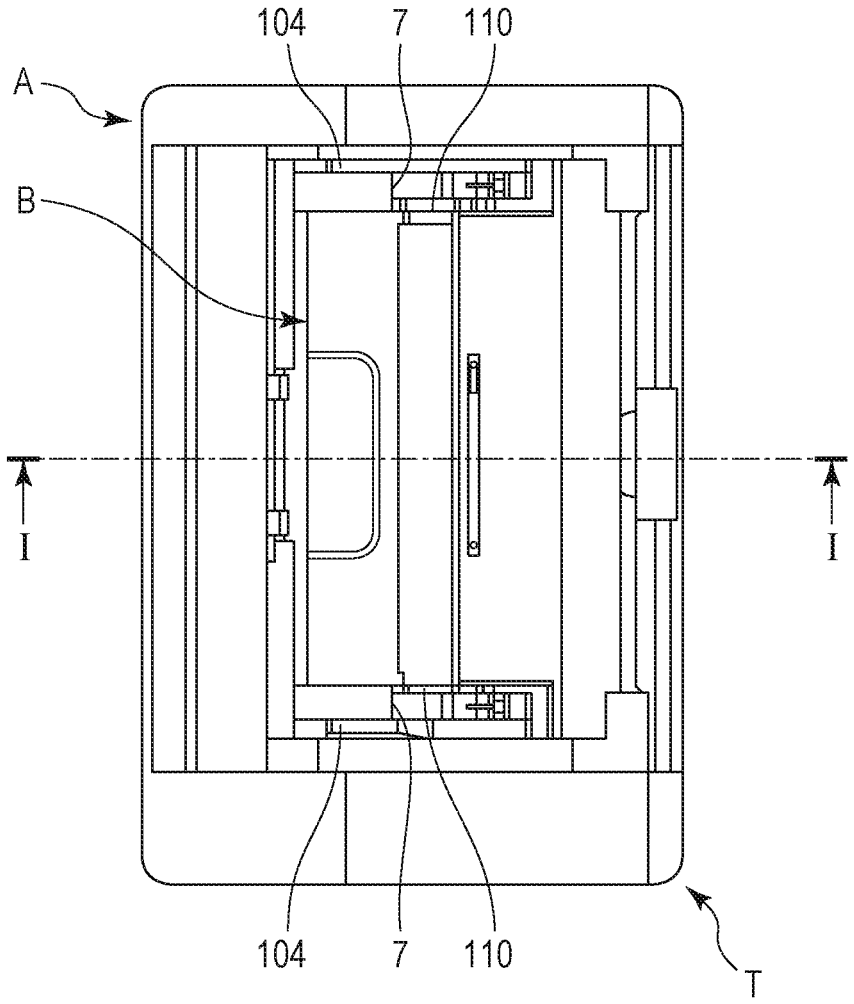
FIG. 2 is a top view of the image-forming apparatus according to the first embodiment of the present invention.
Figure 3:
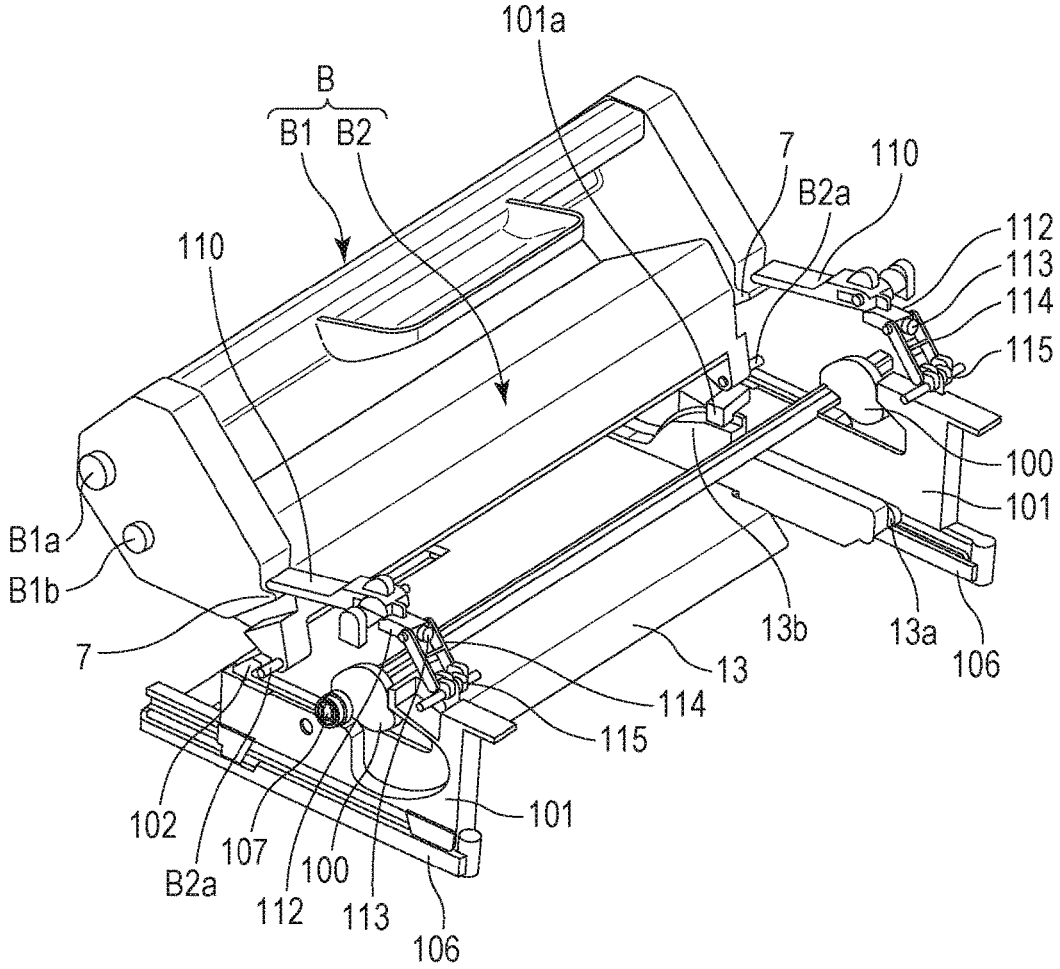
FIG. 3 is a perspective view of the image-forming apparatus according to the first embodiment of the present invention.
Figure 4A:
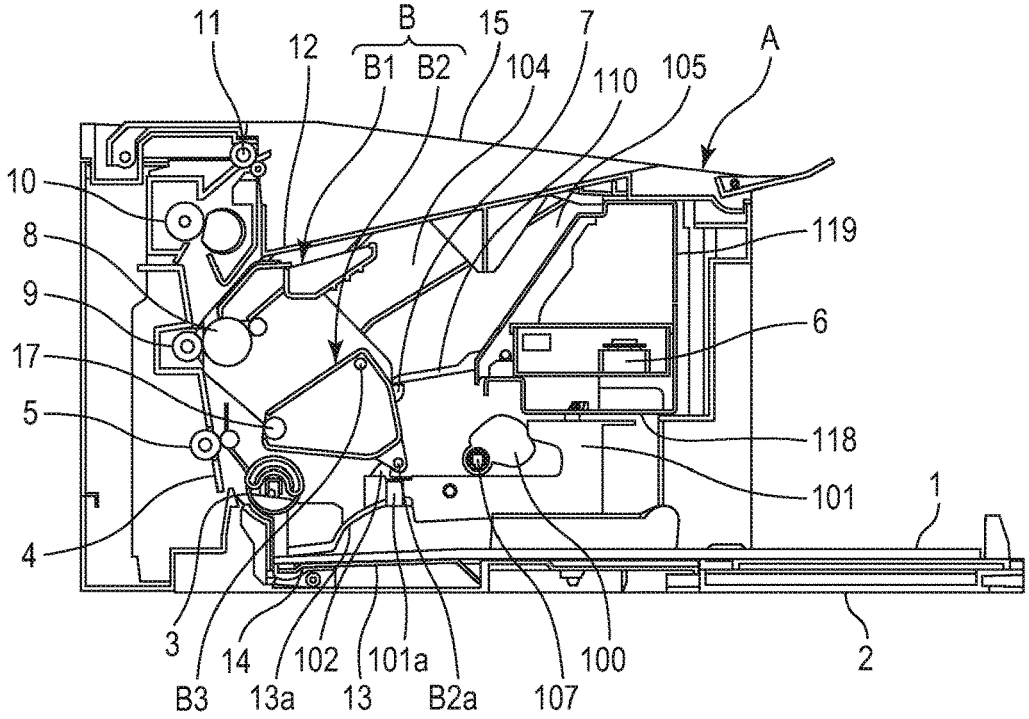
FIGS. 4A and 4B are sectional views of the image-forming apparatus according to the first embodiment of the present invention and each illustrate the operation of the image forming apparatus.
Figure 4B:
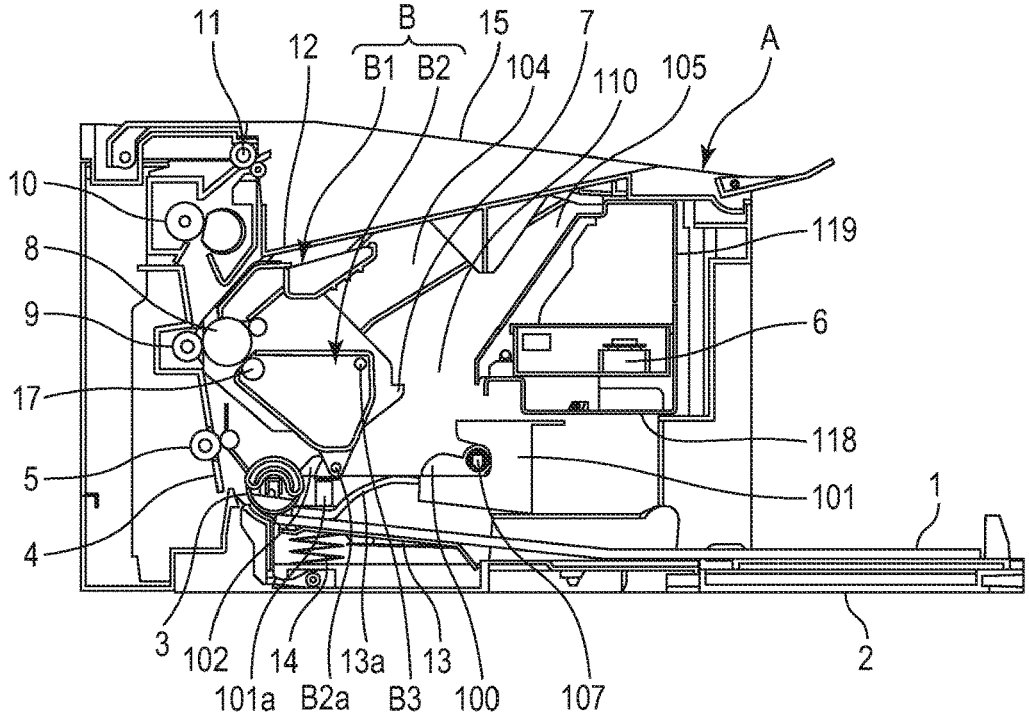
Figure 5A:
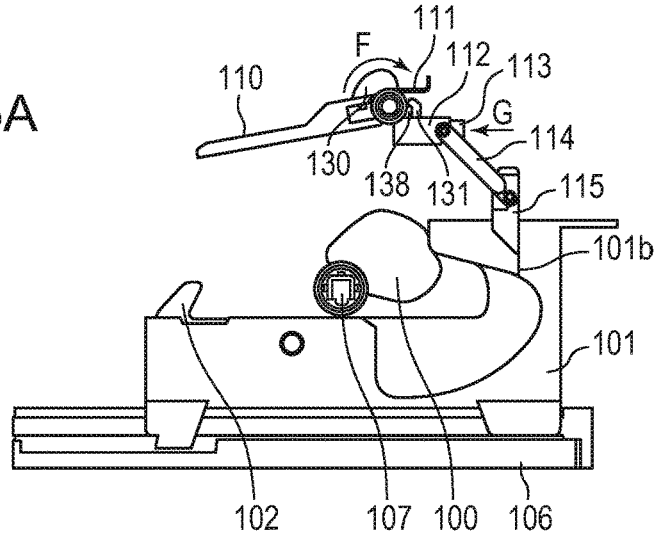
FIGS. 5A to 5C each illustrate the operation of the image-forming apparatus according to the first embodiment of the present invention.
Figure 5B:
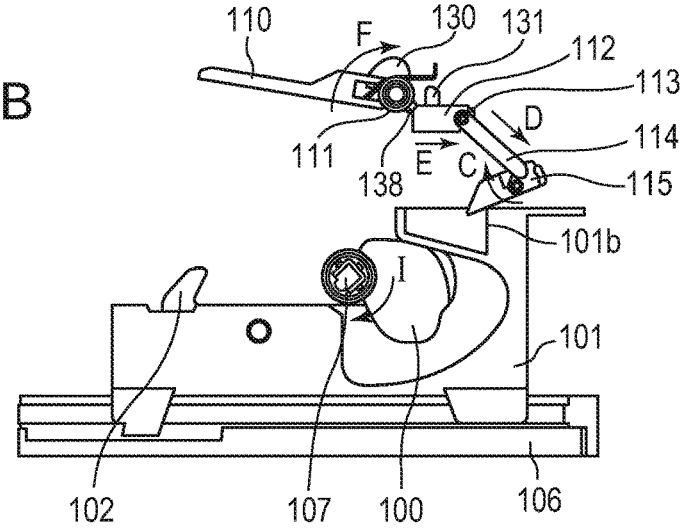
Figure 5C:
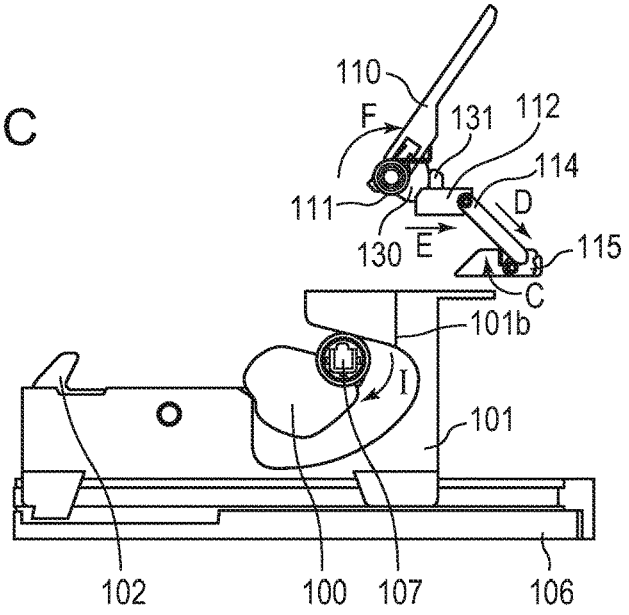

The image-forming apparatus according to the first embodiment will be described below with reference to FIG. 1 to FIG. 5C. FIG. 1 is a sectional view of the image-forming apparatus according to the first embodiment during transportation with a process cartridge (referred to below as a cartridge) installed in the apparatus main body and packed together. FIG. 2 is a top view thereof. In FIG. 2, a door 15 is omitted to illustrate the position of press members 110 (restricting members). FIG. 1 is a sectional view of the image-forming apparatus taken along line I-I in FIG. 2, which is a top view thereof. FIG. 3 is a perspective view of a main part of the image-forming apparatus according to the first embodiment viewed from above (direction of an arrow T in FIG. 2) and illustrates the structure thereof during transportation with the process cartridge installed in the apparatus main body and packed together. FIGS. 4A and 4B are sectional views of the image-forming apparatus according to the first embodiment. FIG. 4A illustrates an intermediate state between transportation and the start of image formation. FIG. 4B illustrates a state where an image can be formed. FIGS. 5A to 5C each illustrate the operation of the press members 110 in the image-forming apparatus according to the first embodiment. FIG. 5A illustrates a state of an apparatus main body A during transportation. FIG. 5B illustrates a state where the press members 110 are released and release members (levers) are located at a first position. FIG. 5C illustrates a state where the press members 110 are released and the release members are located at a second position.

The structure of the image-forming apparatus during transportation will now be described with reference to FIG. 1 to FIG. 3, and FIG. 5A. A cartridge B is attachable to and detachable from the apparatus main body A via an opening that appears when the door 15 disposed on the upper side of the apparatus main body A opens. The cartridge B includes a drum cartridge B1 including a photosensitive drum 8 and a developing cartridge B2 including a development roller 17, which is a developer-hearing member that supplies a developer to the photosensitive drum 8. The developing cartridge B2 of the cartridge B can pivot on a pivot center B3 with respect to the drum cartridge B1. The developing cartridge B2 is urged toward the drum cartridge B1 by using an elastic body, not illustrated, such that the development roller 17 comes in contact with the photosensitive drum 8.

The cartridge B includes bosses B1*a* and B1*b* (FIG. 3), which are positioning portions, on both sides of the drum cartridge B1 in the longitudinal direction, and the bosses B1*a* and B1*b* engage respective cartridge guides 104 disposed in the apparatus main body A, so that the cartridge B is movable in the direction in which the cartridge B is attached or detached. The position of the drum cartridge B1 of the cartridge B inserted into the inside of the apparatus main body A is set at a position at which the photosensitive drum 8 is in contact with a transfer roller 9.

During transportation, movement of the cartridge B in the direction in which the cartridge B is detached is restricted in a manner in which the press members 110 are configured to be contact with respective press surfaces 7 formed on the drum cartridge B1. More specifically, as illustrated in FIG. 5A, the press members 110 are urged clockwise (direction F) by using respective press-member springs 111, which are coil springs. Locking members 112 each including an engagement portion are slidably disposed in the apparatus main body A so as to inhibit the press members 110 from swinging. The locking members 112 are located at a lock position at which each engagement portion engages the corresponding press member 110 in a manner in which the locking members 112 are urged against the respective press members 110 in a direction G by using locking-member springs 113, which are compression springs. Thus, during transportation, the press members 110 are located so as to be in contact with the respective press surfaces 7 formed on the drum cartridge B1, and movement of the cartridge B can be restricted.

The locking members 112 are connected to one end of respective links 114 that are swingable. Release members 115 that are swingable are connected to the other end of the respective links 114. Sliders 101 are urged in the direction from the front side to the rear side of the apparatus main body A. However, the sliders 101 are located at the first position by using separation cams 100, and movement of the sliders 101 is restricted. Consequently, the release members 115 are not moved by the sliders 101, and the locking members 112 remain at the lock position. The separation cams 100 are secured to a separation-cam shaft 107 supported by a frame member 105 in the apparatus main body A and are rotatable about the separation-cam shaft 107 when a driving force is applied thereto from a driving unit disposed in the apparatus main body A.

As illustrated in FIG. 3, the developing cartridge B2 includes engagement bosses B2*a*, and the engagement bosses B2*a* engage respective engagement portions 102 (hooks) of the sliders 101. During transportation, the sliders 101 are located at the first position, and the developing cartridge B2 pivots on the pivot center B3 with respect to the drum cartridge B1 against the elastic force of the elastic body disposed in the cartridge B (FIG. 1). Thus, during transportation, the sliders 101 are located at the first position by using the separation cams 100, which are rotatable about the separation-cam shaft 107, and causes the developing cartridge B2 to pivot, so that the development roller 17 is separated from the photosensitive drum 8.

As illustrated in FIG. 3, slider bosses 101*a* are formed on the respective sliders 101, and the slider bosses 101*a* engage a lift plate 13 that is swingable about a swing center 13*a* with respect to slider guides 106. Lift-plate ribs 13*b* are disposed at both ends of the lift plate 13 in the direction of a swing axis. Movement of the lift plate 13 is restricted in a manner in which the lift-plate ribs 13*b* engage the respective slider bosses 101*a* with the lift plate 13 urged upward by using a lift-plate spring 14, which is a compression spring. Thus, during transportation, the sliders 101 are located at the first position, the lift plate 13 is located on the lower side against the urging force of the lift-plate spring 14 urging the lift plate 13 upward, and the lift plate 13 is separated from the sheet-feeding roller 3 (FIG. 1). That is, during transportation, the sliders 101 are located at the first position with respect to the slider guides 106 by using the separation cams 100, which are rotatable about the separation-cam shaft 107, and causes the lift plate 13 to move, so that the sheet materials 1 stacked on the lift plate 13 are separated from the sheet-feeding roller 3.

The structure of the image-forming apparatus when an image can be formed will now be described with reference to FIG. 4B, FIG. 5B, and FIG. 5C.

The position of the drum cartridge B1 of the cartridge B inserted into the inside of the apparatus main body A is set at a position at which the photosensitive drum 8 is in contact with the transfer roller 9 as in the case of transportation. However, the press surfaces 7 formed on the drum cartridge B1 of the cartridge B are not in contact with the press members 110. That is, the cartridge B is movable in the direction in which the cartridge B is detached.

More specifically, as illustrated in FIG. 5B, the separation cams 100 are subjected to a driving force from the driving unit disposed in the apparatus main body A and rotate about the separation-cam shaft 107 clockwise (direction I) from a state of transportation. Thus, the sliders 101, which are urged from the front side to the rear side of the apparatus main body A, are located at the second position, which is away from the first position to the rear side. When the sliders 101 are located at the second position, as illustrated in FIG. 5B, the release members 115 are in contact with the respective contact surfaces 101*b* of the sliders 101 and swing clockwise (direction C). The swing of the release members 115 causes the locking members 112 to move to a release position at which the engagement portions disposed on the locking members 112 disengage from press-member engagement portions 138 disposed on the press members 110 against the urging force of the locking-member springs 113. Thus, the press members 110 urged by the press-member springs 111 moves toward a retracted position. At this time, the release members 115 are in contact with the respective sliders 101 (FIG. 5B).

As illustrated in FIG. 5C, when the separation cams 100 are subjected to a driving force from the driving unit, the separation cams 100 execute a half-turn clockwise (direction I) from a state of transportation. Thus, the sliders 101, which are urged from the front side to the rear side of the apparatus main body A, are located at a third position, which is away from the second position to the rear side. The press members 110 urged by the press-member springs 111 moves to the retracted position. Cams 130 are disposed near the swing center of the respective press members 110 and come into contact with respective protrusions 131 formed on the locking members 112 in conduction with movement of the press members 110 to the retracted position. The release members 115 move from the first position (FIG. 5B), at which the release members 115 release the press members 110, to the second position (retracted position) rotated clockwise (direction C). Thus, the cams 130 press the locking members 112 and the release members 115 move to the retracted position, so that a space is created between each release member 115 and the corresponding slider 101 (FIG. 5C).

When an image can be formed, the developing cartridge B2 is urged against the drum cartridge B1 by using the elastic body disposed in the cartridge B (FIG. 4B). When the sliders 101 are located at the third position, the engagement bosses B2*a* formed on the developing cartridge B2 disengage from the engagement portions 102 of the sliders 101. Consequently, the development roller 17 of the developing cartridge B2 can come into contact with the photosensitive drum 8 of the drum cartridge B1 by using the elastic body disposed in the cartridge B. Thus, during image formation, the sliders 101 are located at the second position with respect to the slider guides 106 by using the separation cams 100, which are rotatable about the separation-cam shaft 107, and causes the developing cartridge B2 to pivot, so that the photosensitive drum 8 and the development roller 17 can come in contact with each other.

As illustrates in FIG. 4B, when the sliders 101 are located at the third position, the positions of the lift-plate ribs 13*b* in contact with the slider bosses 101*a* differ from positions when the sliders 101 are located at the first position. That is, when the sliders 101 are located at the third position, the elastic force of the lift-plate spring 14 causes the lift plate 13 to move upward unlike the case where the sliders 101 are located at the first position, the lift plate 13 comes into contact with the sheet-feeding roller 3, enabling the sheet materials 1 to be conveyed. Thus, during image formation, the sliders 101 are located at the third position by using the separation cams 100, which are rotatable about the separation-cam shaft 107, and enable the lift plate 13 to move, so that each sheet material 1 stacked on the lift plate 13 can come into contact with the sheet-feeding roller 3.

The operation of transition from transportation of the image-forming apparatus to image formation will now be described with reference to FIG. 4A to FIG. 5C. According to the first embodiment, a driving force from the driving unit in the apparatus main body A causes the separation cams 100, which are rotatable about the separation-cam shaft 107, to execute a half-turn clockwise (direction I). In response to this, the press members 110, the lift plate 13, and the developing cartridge P2 move in conjunction with the sliders 101 moving from the first position to the third position.

The operation of components will be described below in detail. The operation of the separation cams 100 will now be described with reference to FIG. 3 to FIG. 5C. FIG. 4A illustrates a state where the image-forming apparatus according to the first embodiment waits printing. When a print job signal is inputted from the host computer, not illustrated, connected to the apparatus main body A, the separation cams 100 start to rotate clockwise (direction I) about the separation-cam shaft 107. This imparts translational motion to the sliders 101, which are urged from the front side to the rear side of the apparatus main body A, and the sliders 101 move to the second position while being in contact with the separation cams 100.

While the sliders 101 move from the first position to the second position, as illustrated in FIG. 5B, the release members 115 come into contact with the sliders 101 and rotate clockwise (direction C). The swing of the release members 115 causes the links 114 to be pulled in a direction D, and this imparts translational motion to the locking members 112 against the urging force of the locking-member springs 113. Consequently, the locking members 112 move from the lock position to the release position, and the engagement portions disposed on the locking members 112 disengage from the press-member engagement portions 138 disposed on the press members 110, so that the press members 110 can move. Thus, the press members 110 urged by the press-member springs 111 moves from the restricted position to the retracted position.

When the sliders 101 subsequently move from the second position to the third position, as illustrated in FIG. 5C, the press members 110 urged by the press-member springs 111 are located at the retracted position. The cams 130 disposed near the swing center of the press members 110 come into contact with the protrusions 131 formed on the locking members 112 in conjunction with movement of the press members 110 to the retracted position, and this imparts translational motion to the locking members 112 in a direction E against the urging force of the locking-member springs 113. The links 114 are pressed in the direction D, and the release members 115 move from the first position (FIG. 5B), at which the release members 115 release the press members 110, to the second position (retracted position) rotated clockwise (direction C), so that a space is created between each release member 115 and the corresponding slider 101.

When the sliders 101 move from the first position to the third position, the engagement bosses B2*a* disposed on the developing cartridge B2 disengage from the engagement portions 102 of the sliders 101. Consequently, the development roller 17 of the developing cartridge B2 can come into contact with the photosensitive drum 8 of the drum cartridge B1 by using the elastic body disposed in the cartridge B.

When the sliders 101 move from the first position to the third position, the urging force of the lift-plate spring 14 urging the lift plate 13 upward causes the lift-plate ribs 13*b* to come into sliding contact with the slider bosses 101*a*, and the lift plate 13 moves upward so as to follow the shape of the lift-plate ribs 13*b*. Thus, each sheet material 1 stacked on the lift plate 13 comes into contact with the sheet-feeding roller 3 and can be fed.

According to the first embodiment, after a printing process for a print job that needs one sheet to multiple sheets is finished, the separation cams 100 further execute a half-turn clockwise (direction I) from the position illustrated in FIG. 4B, and translational motion from the rear side to the front side is imparted to the sliders 101 and the sliders 101 move to the first position. Thus, the sliders 101 move to the first position to enable the developing cartridge B2 to pivot while the press members 110 remain at the retracted position. A contact-separation mechanism is used to separate the photosensitive drum 8 and the development roller 17 from each other, and the lift plate 13 moves such that the sheet materials 1 stacked on the lift plate 13 are separated from the sheet-feeding roller 3. Every time a print job signal is inputted, the contact-separation mechanism separates the photosensitive drum 8 and the development roller 17 from each other, and a movement mechanism separates the sheet materials 1 stacked on the lift plate 13 and the sheet-feeding roller 3.

With the above structure, during transportation of the image-forming apparatus, the press members 110 can restrict movement of the cartridge B, and the press members 110 can be released in conjunction with movement of the separation cams 100 during image formation. The release members 115 can be retracted in conjunction with movement of the cams 130 disposed near the swing center of the press members 110. During image formation, the space created between each release member 115 and the corresponding slider 101 prevents the release members 115 and the sliders 101 from interfering and coming into contact with each other when the sliders move. That is, the press members 110 can be automatically released when a user inputs a print job signal from the host computer connected to the apparatus main body A. Thus, it is not necessary for a user to be conscious of the operation of the press members 110, and the user can prepare image formation without removing the cushioning material only in a manner in which the image-forming apparatus is installed, cables, for example, are connected thereto, and the sheet materials 1 are loaded.

In a packing process, the cartridge B can be easily secured to the apparatus main body A in a manner in which the press members 110 are engaged with the press surfaces 7 of the cartridge B and the locking members 112 are moved to the lock position. The cartridge B can be easily secured without any special tool, and it is not necessary for the apparatus main body A to be disassembled nor assembled, because when the door 15 opens, the locking members 112 are accessible from a path along which the cartridge B is inserted. Since the press members 110 are located in the inside of the apparatus main body A, the press members 110 are not conspicuous for product appearance, and it is not necessary for a user to be conscious of the presence of the press members 110.

The structure according to the first embodiment eliminates the need that a user removes the cushioning material to improve the usability and prevents malfunction of the image-forming apparatus due to the cushioning material, even when the process cartridge is packed together with the apparatus main body A.

Second Embodiment

Figure 6:
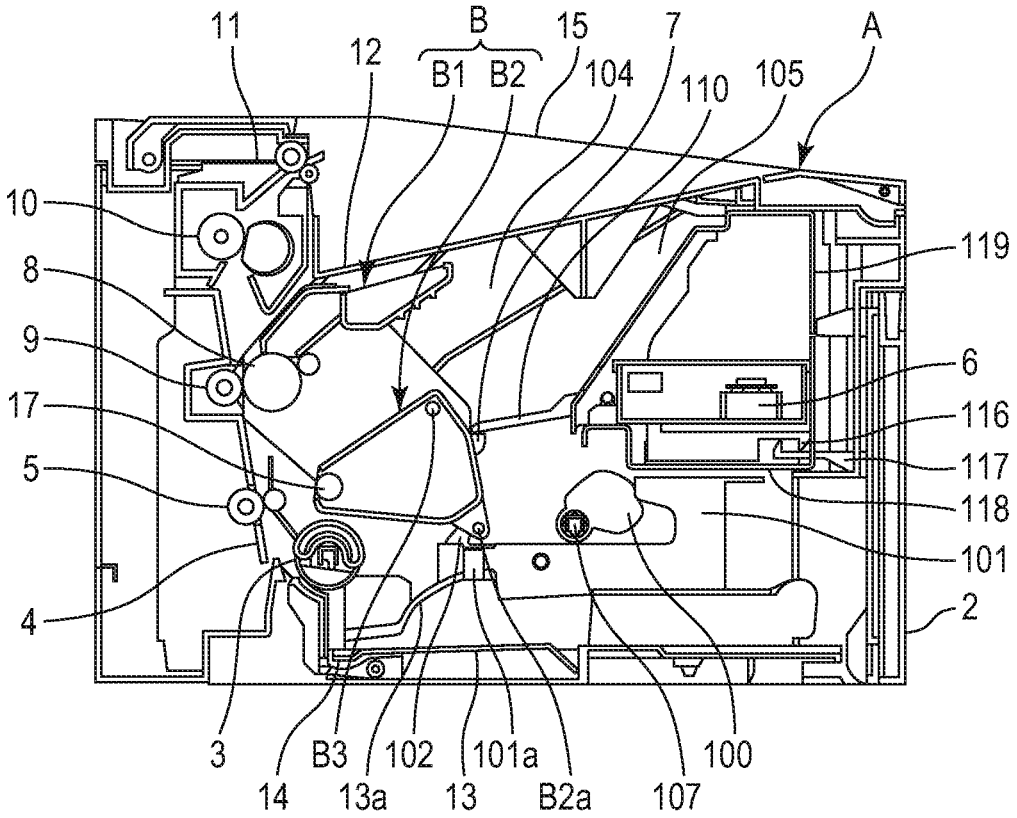
FIG. 6 is a sectional view of an image-forming apparatus according to a second embodiment of the present invention.
Figure 7A:
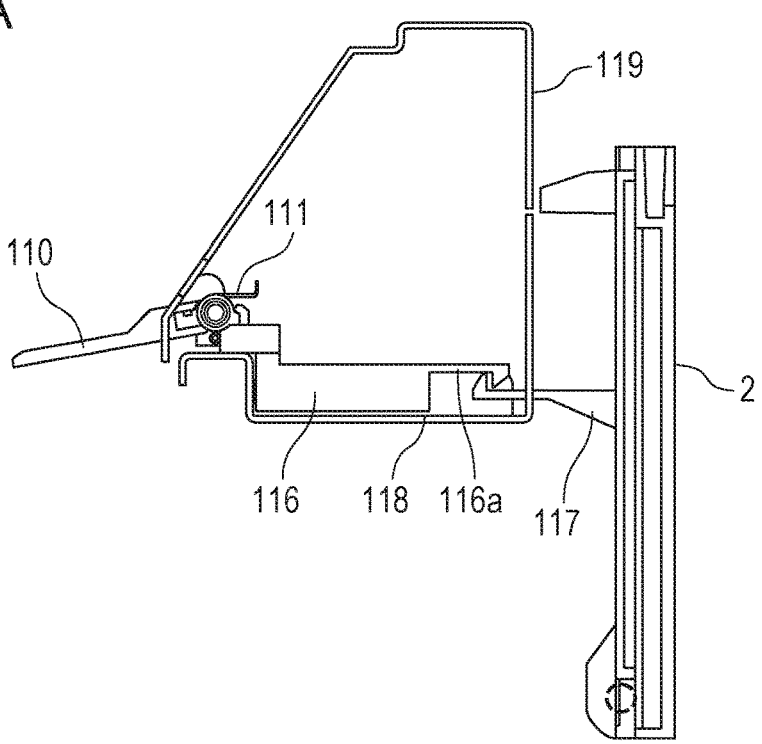
FIGS. 7A and 7B are sectional views of the image-forming apparatus according to the second embodiment of the present invention and each illustrate the operation of the image forming apparatus.
Figure 7B:
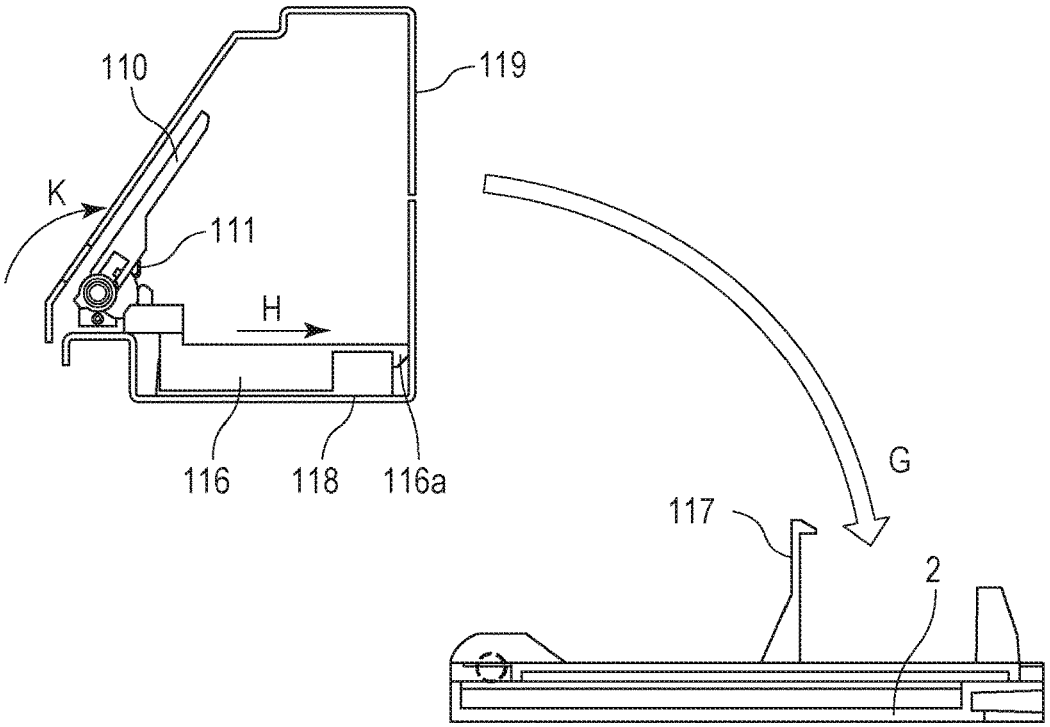

FIG. 6 and FIGS. 7A and 7B are sectional views of an image-forming apparatus according to a second embodiment of the present invention and illustrate the operation of the image-forming apparatus. According to the first embodiment, the locking members 112 are used for a locking mechanism that restricts movement of the press members 110 in conjunction with movement of the separation cams 100. According to the second embodiment, however, the locking mechanism operates in conjunction with operation of opening a sheet tray 2 (movable member) that enables each sheet material 1 to be supplied. Components except for locking members 116 and lock-releasing members 117 (hooks) are the same as in the first embodiment and designated by like symbols, and description thereof is omitted.

The locking mechanism for the press members 110 according to the second embodiment will be described in detail with reference to FIGS. 7A and 7B. During transportation, the press members 110 in the apparatus main body A are located so as to be in contact with the respective press surfaces 7 formed on the drum cartridge B1 of the cartridge B, and movement of the cartridge B can be restricted, as in the first embodiment. Specifically, as illustrated in FIG. 7A, the press members 110 are urged clockwise by using the respective press-member springs 111, which are coil springs. The locking members 116 each including an engagement portion are slidably disposed in the apparatus main body A to inhibit the press members 110 from swinging. During transportation, the locking members 116 each including the engagement portion are located at the lock position at which each engagement portion engages the corresponding press member 110 in a manner in which the locking members 116 are urged against the respective press members 110 by using the locking-member springs 113, not illustrated. Thus, during transportation, the press members 110 are located so as to be in contact with the respective press surfaces 7 formed on the drum cartridge B1, and movement of the cartridge B can be restricted. According to the second embodiment, the locking members 116 are secured to a scanner stay 118 secured to the apparatus main body A so as to be slidable in the direction toward the front side and the direction toward the rear side of the apparatus main body A. A scanner cover 119 is attached so as to cover a scanner unit 6 disposed on the scanner stay 118.

The locking members 116 each include a hook 116*a* at the end thereof on the front side of the apparatus main body A. During transportation, as illustrated in FIG. 7A, each hook 116*a* does not engage the corresponding lock-releasing member 117 disposed on the sheet tray 2 located at a close position at which the sheet tray 2 closes the opening of the apparatus main body A, and the locking members 116 are located at the lock position. During image formation, a user swings the sheet tray 2 in the direction of an arrow G to an open position so that the opening of the apparatus main body A is opened to insert the sheet materials 1. When the sheet tray 2 is thus released, each hook 116*a* temporarily engages the corresponding lock-releasing member 117, and the locking members 116 are pulled toward the front side (direction H) of the apparatus main body A. This imparts translational motion to the locking members 116 from the lock position to the release position against the urging force of the locking-member springs 113, the engagement portions disposed on the locking members 116 disengage from the press members 110. Consequently, the press members 110 urged by the press-member springs 111 rotate clockwise (direction K) and move to the retracted position (FIG. 7B).

With the above structure, during transportation of the image-forming apparatus, the press members 110 can restrict movement of the cartridge B, and the press members 110 can be released in conjunction with operation of releasing the sheet tray 2 before image formation. That is, the press members 110 can be automatically released when a user loads the sheet materials 1 in the apparatus main body A. Thus, it is not necessary for a user to be conscious of the operation of the press members 110, and the user can prepare image formation without removing the cushioning material only in a manner in which the image-forming apparatus is installed, cables, for example, are connected thereto, and the sheet materials 1 are loaded.

Third Embodiment

Figure 8A:
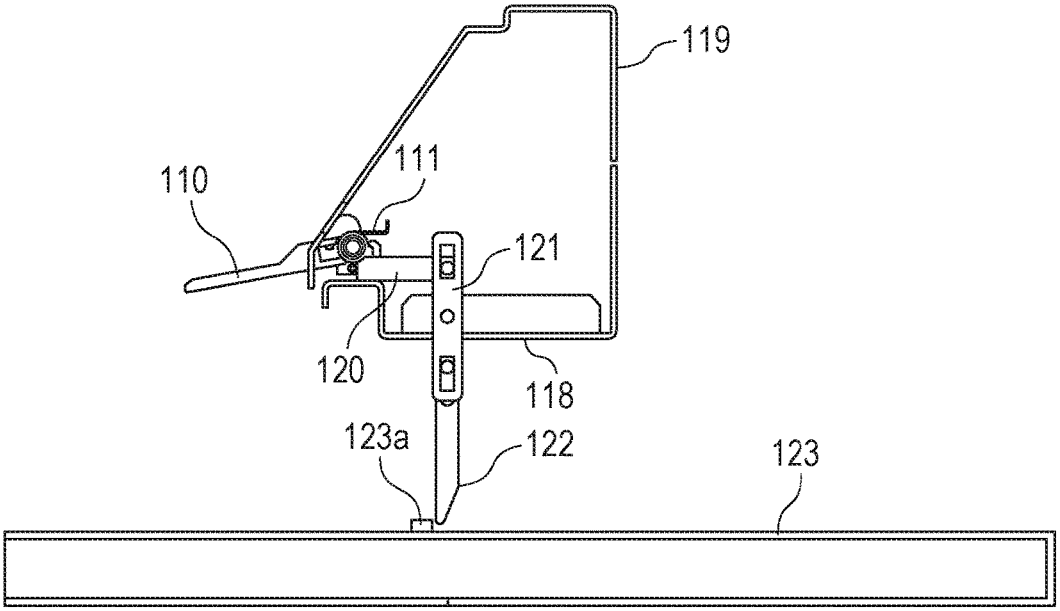
FIGS. 8A and 8B are sectional views of an image-forming apparatus according to a third embodiment of the present invention and each illustrate the operation of the image forming apparatus.
Figure 8B:
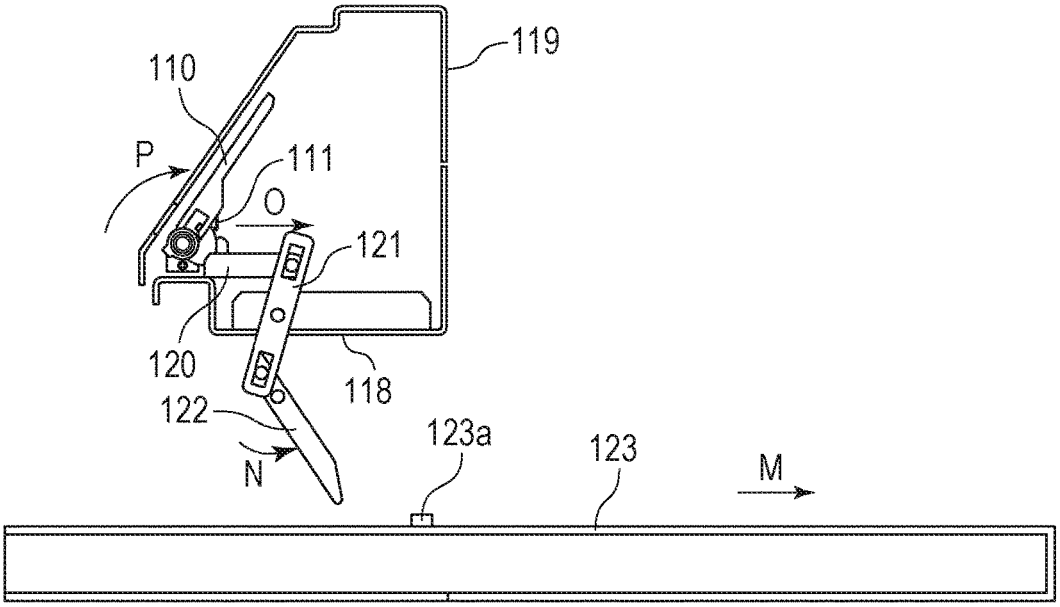

FIGS. 8A and 8B are sectional views of an image-forming apparatus according to a third embodiment of the present invention and illustrate the operation of the image-forming apparatus. According to the third embodiment, the locking mechanism operates in conjunction with operation of extracting a sheet cassette 123 (movable member) in which the sheet materials 1 are loaded unlike the locking mechanism for the press members 110 described in the first embodiment. Components except for locking members 120 and release members 122 are the same as in the first embodiment and designated by like symbols, and description thereof is omitted.

The locking mechanism for the press members 110 according to the third embodiment will be described in detail with reference to FIGS. 8A and 8B. During transportation, the press members 110 in the apparatus main body A are located so as to be in contact with the respective press surfaces 7 formed on the drum cartridge B1 of the cartridge B, and movement of the cartridge B can be restricted, as in the first embodiment. Specifically, as illustrated in FIG. 8A, the press members 110 are urged clockwise by using the respective press-member springs 111, which are coil springs. The locking members 120 each including an engagement portion are slidably disposed in the apparatus main body A to inhibit the press members 110 from swinging. During transportation, the locking members 120 each including the engagement portion are located at the lock position at which each engagement portion engages the corresponding press member 110 in a manner in which the locking members 120 are urged against the respective press members 110 by using the locking-member springs 113, not illustrated. Thus, during transportation, the press members 110 are located so as to be in contact with the respective press surfaces 7 formed on the drum cartridge B1, and movement of the cartridge B can be restricted. According to the third embodiment, the locking members 120 are secured to the scanner stay 118 secured to the apparatus main body A so as to be movable in the direction toward the front side and the direction toward the rear side of the apparatus main body A. The scanner cover 119 is attached so as to cover the scanner unit 6 disposed on the scanner stay 118.

The locking members 120 engage one end of respective links 121 that are swingable. When the links 121 swing, the locking members 120 can slide. The other end of each link 121 engages the corresponding release member 122 (lever). When the release members 122 swing, the links 121 can swing. During transportation, as illustrated in FIG. 8A, the sheet cassette 123 has been installed. At this time, protrusions 123*a* formed on the sheet cassette 123 are located downstream of the release members 122 in the direction in which the sheet cassette 123 is extracted, and the protrusions 123*a* do not engage the release members 122.

During image forming, as illustrated in FIG. 8B, a user slides the sheet cassette 123 in a direction M in which the sheet cassette 123 is extracted and loads the sheet materials 1. When the sheet cassette 123 is extracted, the protrusions 123*a* engage the respective release members 122, and the release members 122 swing counterclockwise (direction N). When the release members 122 swing, the links 121 swing, and the locking members 120 are pulled toward the front side (direction O) of the apparatus main body A. This imparts translational motion to the locking members 120 from the lock position to the release position against the urging force of the locking-member springs 113, and the engagement portions disposed on the locking members 120 disengage from the press members 110. Consequently, the press members 110 urged by the press-member springs 111 rotate clockwise (direction P) and move to the retracted position.

With the above structure, during transportation of the image-forming apparatus, the press members 110 can restrict movement of the cartridge B, and the press members 110 can be released in conjunction with operation of extracting sheet cassette 123 before image formation. That is, the press members 110 can be automatically released when a user loads the sheet materials 1 in the apparatus main body A. Thus, it is not necessary for a user to be conscious of the operation of the press members 110, and the user can prepare image formation without removing the cushioning material only in a manner in which the image-forming apparatus is installed, cables, for example, are connected thereto, and the sheet cassette 123 is extracted to load the sheet materials 1.

Fourth Embodiment

Figure 9A:
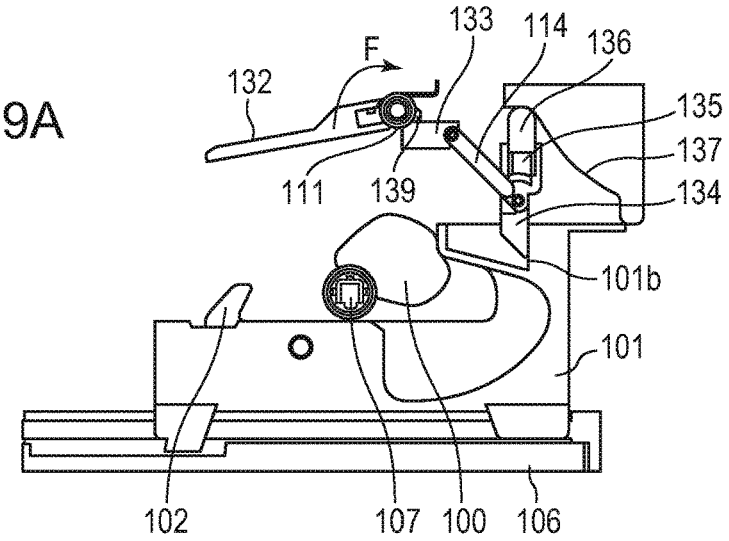
FIGS. 9A to 9C are sectional views of an image-forming apparatus according to a fourth embodiment of the present invention and each illustrate the operation of the image forming apparatus.
Figure 9B:
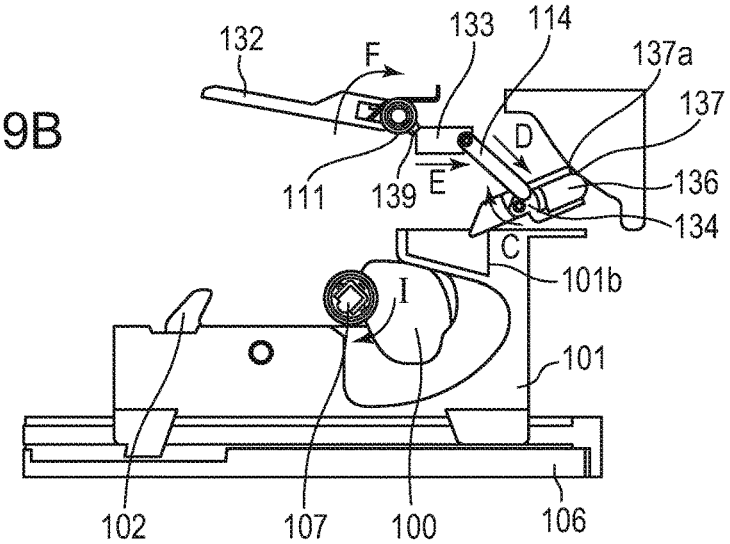
Figure 9C:
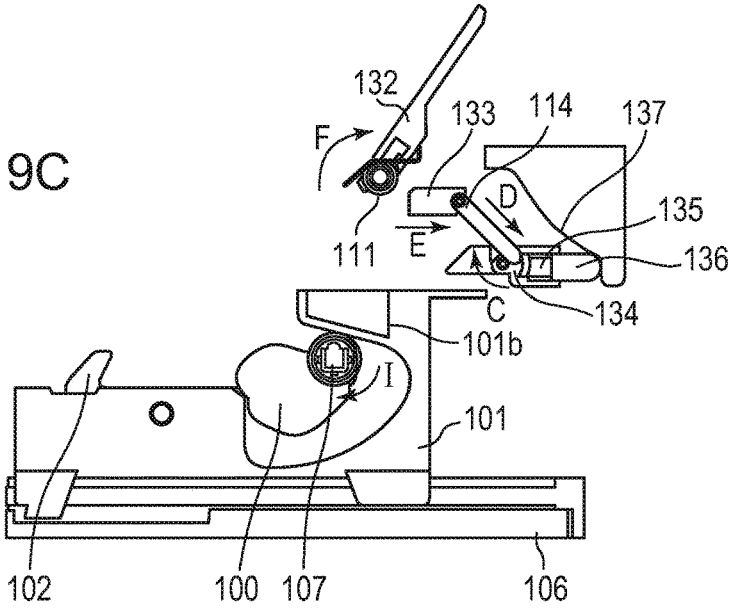
Figure 10:
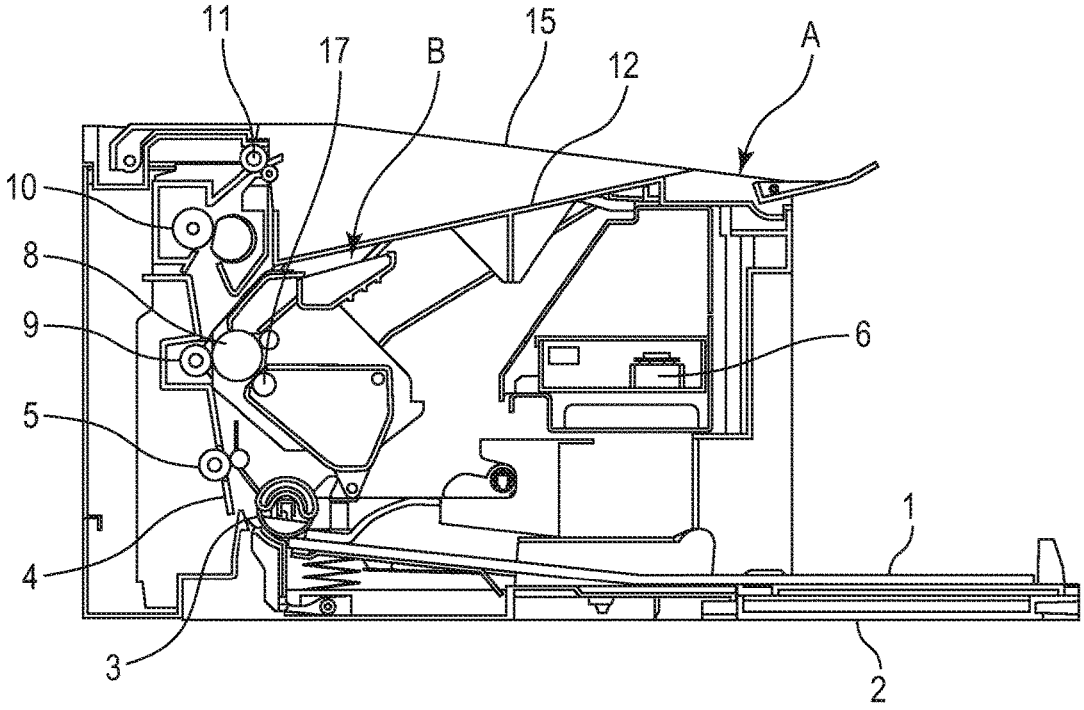
FIG. 10 Related Art
FIG. 10 is a sectional view of a conventional image forming apparatus.
Figure 11A:
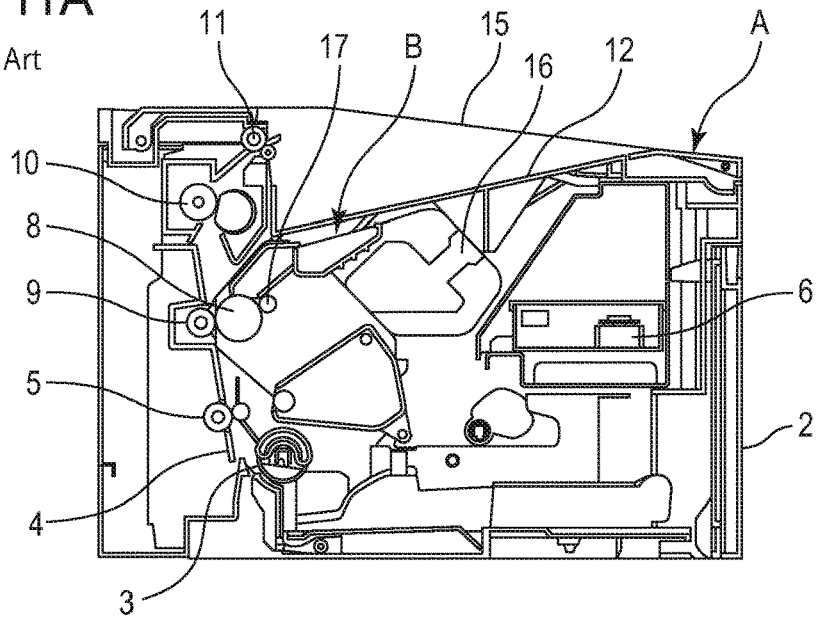
FIG. 11A Related Art
FIGS. 11A and 11B are sectional views of the conventional image-forming apparatus and each illustrate the operation of the conventional image forming apparatus.
Figure 11B:
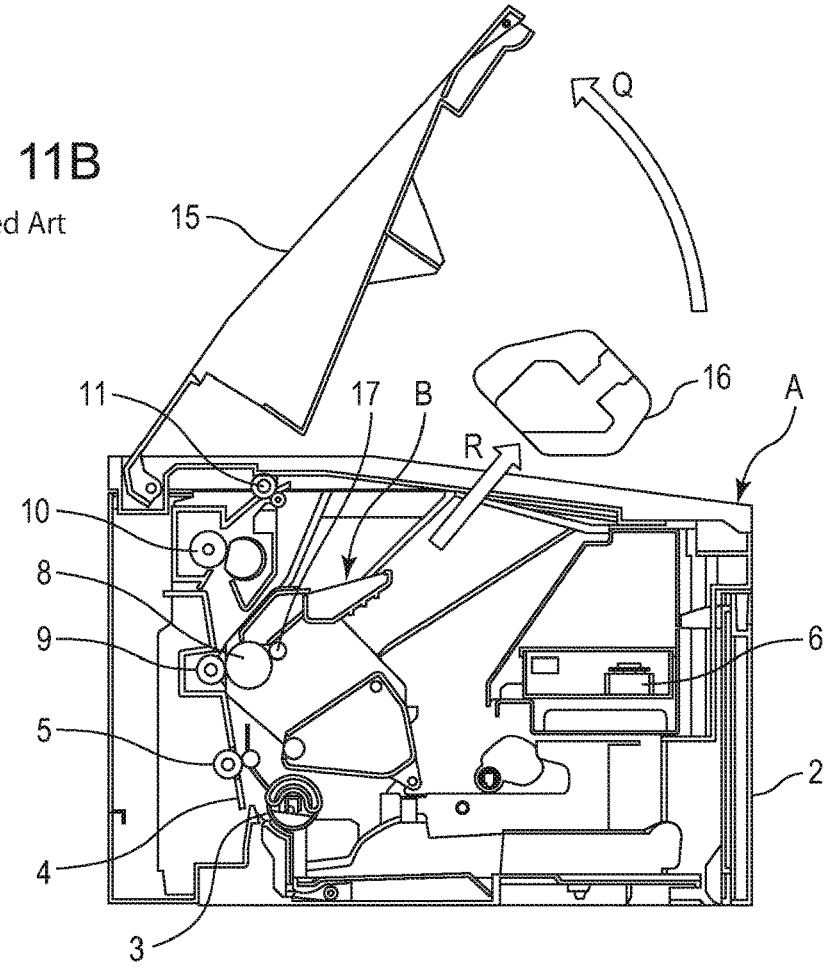
FIG. 11B Related Art

FIGS. 9A to 9C are sectional views of an image-forming apparatus according to a fourth embodiment of the present invention and illustrate the operation of the image-forming apparatus. FIGS. 9A to 9C each illustrate movement of the press members 110 of the image-forming apparatus according to the fourth embodiment. FIG. 9A illustrates a state of transportation of the apparatus main body A. FIG. 9B illustrates a state where press members 132 are released and release members 134 (levers) are located at the first position. FIG. 9C illustrates a state where the press members 132 are released and the release members 134 are located at the second position. According to the fourth embodiment, a retraction mechanism for the release members 134 uses retraction cams 137 disposed near the respective release members 134, unlike the retraction mechanism for the release members 115 that uses the cams 130 disposed near the swing center of the press members 110 as described in the first embodiment. Components except for the press members 132, locking members 133, releasing-member urging springs135, the release members 134 are the same as in the first embodiment and designated by like symbols, and description thereof is omitted.

The locking mechanism for the press members 132 and the retraction mechanism for the release members 134 according to the fourth embodiment will be described in detail with reference to FIGS. 9A to 9C. During transportation, the press members 132 in the apparatus main body A are located so as to be in contact with the respective press surfaces 7 formed on the drum cartridge B1 of the cartridge B, and movement of the cartridge B can be restricted, as in the first embodiment. Specifically, as illustrated in FIG. 9A, the press members 132 are urged clockwise by using the respective press-member springs 111, which are coil springs. The locking members 133 each including an engagement portion are slidably disposed in the apparatus main body A to inhibit the press members 132 from swinging.

The locking members 133 engage one end of the respective links 114 that are swingable. When the links 114 swing, the locking members 133 can slide. The release members 134 engage the other end of the respective links 114. When the release members 134 swing, the links 114 can swing.

The releasing-member urging springs 135, which are compression springs, and push members 136 are disposed on an end portion of the respective release members 134. During transportation, the position of the locking members 133 is set in a manner in which the releasing-member urging springs 135 urge the release members 134 and the push members 136 and the links 114 is used. The locking members 133 each include an engagement portion and are located at the lock position at which each engagement portion engages the corresponding press member 132. Thus, during transportation, the press members 132 are located so as to be in contact with the respective press surfaces 7 formed on the drum cartridge B1, and movement of the cartridge B can be restricted.

During transportation, as illustrated in FIG. 9A, the sliders 101 are urged in the direction from the front side to the rear side of the apparatus main body A. However, the sliders 101 are located at the first position by using the separation cams 100, and movement of the sliders 101 is restricted. Consequently, the release members 134 are not moved by the sliders 101, and the locking members 133 remain at the lock position.

The structure of the image-forming apparatus when an image can be formed will now be described with reference to FIG. 9B and FIG. 9C.

As illustrated in FIG. 9B, the separation cams 100 are subjected to a driving force from the driving unit disposed in the apparatus main body A and rotate about the separation-cam shaft 107 clockwise (direction I) from a state of transportation. Thus, the sliders 101, which are urged from the front side to the rear side of the apparatus main body A, are located at the second position, which is away from the first position to the rear side. When the sliders 101 are located at the second position, as illustrated in FIG. 9B, the release members 134 are in contact with the respective contact surfaces 101*b* of the sliders 101 and rotate clockwise (direction C). The swing of the release members 134 causes the push members 136 to slide and pass a vertex 137*a* of the respective retraction cams 137 disposed near the release members 134 against the urging force of the releasing-member urging springs 135. The swing of the release members 134 causes the links 114 to be pulled in the direction D, and this imparts translational motion to the locking members 133. Consequently, the locking members 133 move from the lock position to the release position, and the engagement portions disposed on the locking members 133 disengage from press-member engagement portions 139 disposed on the press members 132, so that the press members 132 can move. Thus, the press members 132 urged by the press-member springs 111 moves from the restricted position to the retracted position. At this time, the release members 134 are in contact with the respective sliders 101 (FIG. 9B).

As illustrated in FIG. 9C, when the separation cams 100 are subjected to a driving force from the driving unit, the separation cams 100 execute a half-turn clockwise (direction I) from a state of transportation. Thus, the sliders 101, which are urged from the front side to the rear side of the apparatus main body A, are located at the third position, which is away from the second position to the rear side. The press members 132 urged by the press-member springs 111 move to the retracted position. The push members 136 move so as to follow the shape of the retraction cams 137 due to the urging force of the releasing-member urging springs 135, and the release members 134 move from the first position (FIG. 9B), at which the release members 134 release the press members 132, to the second position (retracted position) rotated clockwise (direction C), so that a space is created between each release member 134 and the corresponding slider 101 (FIG. 9C).

With the above structure, during transportation of the image-forming apparatus, the press members 132 can restrict movement of the cartridge B, and the press members 132 can be released in conjunction with movement of the separation cams 100 during image formation as in the first embodiment. When the push members 136 move so as to follow the shape of the retraction cams 137, the release members 134 can be retracted. During image formation, the space created between each release member 134 and the corresponding slider 101 prevents the release members 134 and the sliders 101 from interfering and coming into contact with each other when the sliders 101 move.

With the structure according to the first embodiment, in a packing process, the cartridge B can be easily secured to the apparatus main body A in a manner in which the press members 110 are engaged with the press surfaces 7 of the cartridge B and the locking members 112 are moved to the lock position. However, this is an easy work, and accordingly, there is a possibility that a user unintentionally moves the press members 110 to the positions for transportation, that is, the cartridge B is easily secured to the apparatus main body A. With the structure according to the fourth embodiment, in a packing process, the cartridge B can be secured to the apparatus main body A in a manner in which the press members 132 are engaged with the press surfaces 7 of the cartridge B and the release members 134 are subsequently moved to cause the locking members 133 to move to the lock position. Accordingly, a user can be prevented from unintentionally moving the press members 132 to the positions for transportation.

According to the above embodiments, the cartridge B is integrally formed of the drum cartridge B1 including the photosensitive drum 8 and the developing cartridge B2 including the development roller 17, which is the developer-bearing member that supplies a developer to the photosensitive drum 8. However, this is not a limitation. The cartridge B may include the drum cartridge B1 and the developing cartridge B2 that are separated bodies provided that the developing cartridge B2 can pivot with respect to the drum cartridge B1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-086059 filed Apr. 22, 2016, which is hereby incorporated by reference herein in its entirety.

What is claimed is:

1. An image-forming apparatus, comprising:

a cartridge that is attachable and detachable, includes a drum cartridge, including a photosensitive drum, and a developing cartridge, including a developer-bearing member that supplies a developer to the photosensitive drum;

a contact-separation mechanism that causes the photosensitive drum and the developer-bearing member to come into contact with each other or to separate from each other, the contact-separation mechanism including a portion that is contactable with the cartridge; and a restricting member contactable with the cartridge, configured to restrict movement of the cartridge installed in a main body of the image-forming apparatus, wherein the contact-separation mechanism causes the photosensitive drum and the developer-bearing member to separate from each other while the restricting member restricts the movement of the cartridge with the cartridge installed in the main body, and wherein restriction of the movement of the cartridge by the restricting member is released in conjunction with operation of bringing the photosensitive drum and the developer-bearing member into contact with each other by the contact-separation mechanism.

2. The image-forming apparatus according to claim 1, wherein the cartridge is integrally formed of the drum cartridge and the developing cartridge.

3. The image-forming apparatus according to claim 1, further comprising:

a locking mechanism that moves the restricting member to a position at which the restricting member restricts the movement of the cartridge, and that releases the restriction of the movement by the restricting member in conjunction with the operation of bringing the photosensitive drum and the developer-bearing member into contact with each other by the contact-separation mechanism.

4. The image-forming apparatus according to claim 3, wherein the restricting member is swingable, and wherein the locking mechanism enables the restricting member to swing in conjunction with the operation of bringing the photosensitive drum and the developer-bearing member into contact with each other by the contact-separation mechanism.

5. The image-forming apparatus according to claim 3, wherein the locking mechanism is connected to one end of a link that is swingable, wherein the other end of the link is connected to a release member that is swingable, wherein in a structure that causes the release member to swing, causes the locking mechanism to move by using the link, and releases a lock of the restricting member, the restricting member has a cam shape near a swing center, and wherein the release member moves from a first position at which the release member releases the restricting member to a second position by using the cam shape.

6. The image-forming apparatus according to claim 3, wherein the locking mechanism is connected to one end of a link that is swingable, wherein the other end of the link is connected to a release member that is swingable, wherein in a structure that causes the release member to swing, causes the locking mechanism to move by using the link, and releases a lock of the restricting member, a cam shape is formed near the release member, and wherein the release member moves from a first position at which the release member releases the restricting member to a second position by using the cam shape.

7. The image-forming apparatus according to claim 1, wherein the restricting member is accessible from a path along which the cartridge is inserted, and the restricting member is movable from a retracted position at which the restriction of the movement of the cartridge is released to a restricted position at which the movement of the cartridge is restricted.

8. The image-forming apparatus according to claim 1, wherein the restricting member is movable from a retracted position at which the restriction of the movement of the cartridge is released to a restricted position at which the movement of the cartridge is restricted, and the image forming apparatus further comprises an urging member configured to urge the restricting member toward the retracted position from the restricted position.

9. The image-forming apparatus according to claim 1, wherein the restricting member is configured to contact with the cartridge so as to restrict movement of the cartridge in a detachment direction of the cartridge from the main body.

10. An image-forming apparatus that forms an image on a sheet material, comprising:

a cartridge that is attachable and detachable;

a sheet-feeding roller that comes in contact with the sheet material and thereby enables the sheet material to be conveyed;

a movement mechanism that causes the sheet material to come into contact with the sheet-feeding roller or to separate from the sheet-feeding roller; and a restricting member contactable with the cartridge, configured to restrict movement of the cartridge installed in a main body of the image-forming apparatus, wherein the movement mechanism causes the sheet-feeding roller and the sheet material to separate from each other while the restricting member restricts the movement of the cartridge with the cartridge installed in the main body, and wherein restriction of the movement of the cartridge by the restricting member is released in conjunction with operation of bringing the sheet-feeding roller and the sheet material into contact with each other by the movement mechanism.

11. The image-forming apparatus according to claim 10, further comprising:

a locking mechanism that moves the restricting member to a position at which the restricting member restricts the movement of the cartridge and that releases the restriction of the movement by the restricting member in conjunction with the operation of bringing the sheet-feeding roller and the sheet material into contact with each other by the movement mechanism.

12. The image-forming apparatus according to claim 11, wherein the restricting member is swingable, and wherein the locking mechanism enables the restricting member to swing in conjunction with the operation of bringing the sheet-feeding roller and the sheet material into contact with each other by the movement mechanism.

13. The image-forming apparatus according to claim 11, wherein the locking mechanism is connected to one end of a link that is swingable, wherein the other end of the link is connected to a release member that is swingable, wherein in a structure that causes the release member to swing, causes the locking mechanism to move by using the link, and releases a lock of the restricting member, the restricting member has a cam shape near a swing center, and wherein the release member moves from a first position at which the release member releases the restricting member to a second position by using the cam shape.

14. The image-forming apparatus according to claim 11, wherein the locking mechanism is connected to one end of a link that is swingable, wherein the other end of the link is connected to a release member that is swingable, wherein in a structure that causes the release member to swing, causes the locking mechanism to move by using the link, and releases a lock of the restricting member, a cam shape is formed near the release member, and wherein the release member moves from a first position at which the release member releases the restricting member to a second position by using the cam shape.

15. The image-forming apparatus according to claim 10, wherein the restricting member is accessible from a path along which the cartridge is inserted, and the restricting member is movable from a retracted position at which the restriction of the movement of the cartridge is released to a restricted position at which the movement of the cartridge is restricted.

16. The image-forming apparatus according to claim 10, wherein the restricting member is movable from a retracted position at which the restriction of the movement of the cartridge is released to a restricted position at which the movement of the cartridge is restricted, and the image forming apparatus further comprises an urging member configured to urge the restricting member toward the retracted position from the restricted position.

17. The image-forming apparatus according to claim 10, wherein the restricting member is configured to contact with the cartridge so as to restrict movement of the cartridge in a detachment direction of the cartridge from the main body.

18. An image-forming apparatus that forms an image on a sheet material, comprising:

a cartridge that is attachable and detachable;

a movable member that is movable with respect to a main body of the image-forming apparatus and enables the sheet material to be supplied; and a restricting member contactable with the cartridge, configured to restrict movement of the cartridge installed in the main body of the image-forming apparatus, wherein the movable member is secured to the main body of the image-forming apparatus while the restricting member restricts the movement of the cartridge with the cartridge installed in the main body, and wherein restriction of the movement of the cartridge by the restricting member is released in conjunction with operation of moving the movable member with respect to the image-forming apparatus.

19. The image-forming apparatus according to claim 18, wherein the movable member is a door that is disposed in the image-forming apparatus and that covers an opening through which the sheet material is supplied.

20. The image-forming apparatus according to claim 18, wherein the movable member is a cassette in which the sheet material is loaded.

21. The image-forming apparatus according to claim 18, further comprising:

a locking mechanism that moves the restricting member to a position at which the restricting member restricts the movement of the cartridge and that releases the restriction of the movement by the restricting member in conjunction with the operation of moving the movable member with respect to the image-forming apparatus.

22. The image-forming apparatus according to claim 21, wherein the restricting member is swingable, and wherein the locking mechanism enables the restricting member to swing in conjunction with the operation of moving the movable member with respect to the image-forming apparatus.

23. The image-forming apparatus according to claim 21, wherein the locking mechanism is connected to one end of a link that is swingable, wherein the other end of the link is connected to a release member that is swingable, wherein in a structure that causes the release member to swing, causes the locking mechanism to move by using the link, and releases a lock of the restricting member, the restricting member has a cam shape near a swing center, and wherein the release member moves from a first position at which the release member releases the restricting member to a second position by using the cam shape.

24. The image-forming apparatus according to claim 21, wherein the locking mechanism is connected to one end of a link that is swingable, wherein the other end of the link is connected to a release member that is swingable, wherein in a structure that causes the release member to swing, causes the locking mechanism to move by using the link, and releases a lock of the restricting member, a cam shape is formed near the release member, and wherein the release member moves from a first position at which the release member releases the restricting member to a second position by using the cam shape.

25. The image-forming apparatus according to claim 18, wherein the restricting member is accessible from a path along which the cartridge is inserted, and the restricting member is movable from a retracted position at which the restriction of the movement of the cartridge is released to a restricted position at which the movement of the cartridge is restricted.

26. The image-forming apparatus according to claim 18, wherein the restricting member is movable from a retracted position at which the restriction of the movement of the cartridge is released to a restricted position at which the movement of the cartridge is restricted, and the image forming apparatus further comprises an urging member configured to urge the restricting member toward the retracted position from the restricted position.

27. The image-forming apparatus according to claim 18, wherein the restricting member is configured to contact with the cartridge so as to restrict movement of the cartridge in a detachment direction of the cartridge from the main body.

* * * * *